US006344868B1

(12) United States Patent
Susukida et al.

(10) Patent No.: US 6,344,868 B1
(45) Date of Patent: Feb. 5, 2002

(54) THERMAL HEAD AND METHOD OF MANUFACTURING THE SAME

(75) Inventors: Masato Susukida, Chiba; Katsuto Nagano, Yokohama; Yoshio Saita, Yamanashi; Jun Hirabayashi, Chiba; Jun Hagiwara, Yamanashi; Atsushi Yoshida, Ichikawa, all of (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/120,329

(22) Filed: Jul. 22, 1998

(30) Foreign Application Priority Data

Jul. 23, 1997 (JP) ..... 9-197541
Jul. 23, 1997 (JP) ..... 9-197548

(51) Int. Cl.[7] ..... B41J 2/335
(52) U.S. Cl. ..... 347/202; 347/200; 347/203
(58) Field of Search ..... 347/200, 202, 347/203

(56) References Cited

U.S. PATENT DOCUMENTS

| | | | | |
|---|---|---|---|---|
| 4,616,408 A | | 10/1986 | Lloyd | |
| 4,734,563 A | | 3/1988 | Lloyd | |
| 4,841,120 A | | 6/1989 | Yagino et al. | |
| 5,459,491 A | * | 10/1995 | Takeuchi et al. | 347/201 |

FOREIGN PATENT DOCUMENTS

| | | | | |
|---|---|---|---|---|
| JP | 55-021276 | | 2/1980 | |
| JP | 2-45163 | * | 2/1990 | 347/200 |
| JP | 3-040911 | | 6/1991 | |
| JP | 5-64905 | * | 3/1993 | 347/200 |
| JP | B2-5-64905 | | 9/1993 | |
| JP | 8-029595 | | 3/1996 | |

* cited by examiner

*Primary Examiner*—Huan Tran
(74) *Attorney, Agent, or Firm*—Oliff & Berridge PLC

(57) ABSTRACT

A thermal head including a protection layer having mutually opposed first and second surfaces, said first surface having a flat or protruded printing surface which is brought into contact with a heat sensitive record medium, a heat generating section including resistors and electrodes connected to the electrodes and provided on said second surface of the protection layer, and a reinforcing member made of a low melting pint glass and provided on a side of the heat generating section remote from the protection layer. The reinforcing member improves a mechanical strength of the thermal head. The reinforcing member made of a glass also serves as a heat storage member, and thus a thermal property of the thermal head is improved. The reinforcing member may be formed by an aggregate of ceramic particles. The reinforcing member may contain a heat storage layer made of a low melting point glass and a heat conduction layer provided on the heat storage layer.

7 Claims, 11 Drawing Sheets

50
51
43
23b
23a
24
41
42
21
23b

THERMAL HEAD AND METHOD OF MANUFACTURING THE SAME

BACKGROUND OF THE INVENTION

1. Field of the Invention

This invention relates to a thermal head comprising a protection layer having a printing surface which is brought into contact with a heat sensitive record medium, a heat generating section which includes heat generating resistors and electrodes connected to the heat generating resistors and generates a heat to be transferred to said heat sensitive record medium through said protection layer, and a driving circuit connected to said electrodes for supplying a heating electric power to the electrodes.

The present invention also relates to a method of manufacturing the thermal head of the kind mentioned above.

2. Related Art Statement

The thermal head of the kind described in the preamble has been used in simple and low cost printers using heat sensitive papers and heat transfer papers which do not require a supply of inks. In a printer using such a thermal head, a high image quality and high printing speed have been required. For instance, in a heat transfer type color printer or an index printer installed in an automatic mini-laboratory, a thermal head having a very high resolution such as 600 dpi to 1200 dpi has been required.

However, in such a thermal head, an excellent heating up and cooling down property is required in order to raise a temperature of the heat generating section within a very short time and to dissipate a generated heat at a high rate. Such a high speed heating up and cooling down property is particularly required for avoiding undesired blur in an printed image. In order to attain a prompt heating up, it is required that a generated heat does not escape from the heat generating section, and in order to effect the rapid heat dissipation, a generated heat has to be dissipated as soon as possible. For attaining a desired heating up and cooling down property, these two contradictory problems have to be solved simultaneously.

Various requirements generally required for the thermal head may be summarized as follows.

1) small size, light weight, simple structure
2) low price
3) large image size covering A3 size
4) low power consumption
5) high printing speed
6) high density and high resolution
7) uniform image quality without irregular color
8) maintenance free faculty FIG. 1 is a cross sectional view showing a known typical thermal head. This known thermal head comprises an alumina substrate 1 serving as a heat sink, a heat storage layer 2 formed by depositing a glass having a high melting point of about 1000° C. on the alumina substrate 1, a heat generating resistors 3 formed on the heat storage layer 2, a common electrode 4*a* connected commonly to one ends of the resistors 3, separate electrodes 4*b* connected to the other ends of respective resistors 3, and a protection layer 5 formed on the resistors 3 and electrodes 4*a*, 4*b*. The protection layer 5 operates as an abrasion resistance layer and includes a printing surface against which a heat sensitive record paper 7 is urged by a press roller 6.

Upon manufacturing the heat storage layer 2, a paste prepared by adding glass powders to a binder is applied on the surface of the substrate 1, and then an assembly is heated to sinter the glass. In the known thermal head, the glass having a high melting point is used for the heat storage layer 2 due to the following reasons. When the electrodes 3 is made of a metal having a low electric resistance such as aluminum and copper, the glass of the heat storage layer 2 has to be sintered at a high temperature in order to prevent the electrodes from being oxidized or altered by the heat storage layer. Furthermore, in order to improve a resistance/temperature coefficient (TCR) of the heat generating resistors, the resistors have to be subjected to a relatively high heating treatment, and thus the glass of the heat storage layer should have a melting point higher that a temperature of said heating treatment. The heat storage layer 2 has also a function to compensate a roughness of the surface of the substrate 1.

As shown in FIG. 1, on the substrate 1, there is further secured a driving IC 8 by means of an adhesive layer 9, and the separate electrodes 4*b* are connected to the IC 8 by means of connecting wires 10.

In the conventional thermal head illustrated in FIG. 1, a shallow groove 5*a* is formed in the printing surface of the protection layer 5, and therefore the heat sensitive record paper 7 could not be effectively brought into contact with the printing surface. Therefore, a heat generated by the heat generating resistors 3 could not be efficiently transferred to the heat sensitive record paper 7 through the printing surface.

In order to mitigate the above mentioned problem of the known thermal head shown in FIG. 1, in Japanese Patent Kokai Hei 5-464905, there is proposed another known thermal head as shown in FIG. 2, In this known thermal head, a printing surface is formed to be flat, and therefore a space is hardly formed between the printing surface and a heat sensitive record medium and a thermal efficiency is improved. As shown in FIG. 2, on a flat surface of a preliminary substrate 11, a pealing-off layer 12, a wear and abrasion resistance layer 13, a protection layer 14, a heat generating resistance layer 15, an electrode layer 16 and a heat storage layer 17 made of a synthetic resin are successively applied. After cementing the assembly to a substrate 18 by means of an adhesive layer 19, the preliminary substrate 11 is removed by means of the pealing-off layer 12. In this manner, a flat printing surface 13*a* can be obtained.

However, in the known thermal head illustrated in FIG. 2, in which the heat storage layer 17 is made of a synthetic resin and the printing surface 13*a* constituted by a portion of the wear and abrasion resistance layer 13 is formed to be flat, has the following problem.

Since the heat storage layer 17 is subjected to a high temperature process and is liable to be softened. Therefore, the heat storage layer 17 is preferably made of a heat resistant synthetic resin such as epoxy resin and polyimide resin. However, it has been experimentally confirmed that although the heat storage layer 17 is made of a heat resistant synthetic resin, it is softened during the operation. When the heat resistant layer 17 is softened, it might be deformed to a certain extent. For instance, if a hard particle is introduced between the printing surface of the thermal head and the press roller or heat sensitive paper, the heat storage layer 17 might be locally deformed. Moreover, when the heat storage layer 17 is softened, its mechanical strength is decreased, and thus the thermal head might be deformed and a quality of a printed image might be deteriorated.

In the known thermal head illustrated in FIG. 2, since the heat storage layer 17 is formed after the heat generating resistor layer 15 and electrode layer 16 have been formed, the heat storage layer 17 could never be made of a glass having a high melting point like as the thermal head shown in FIG. 1. Therefore, the above mentioned problem of softening could not be avoided.

Moreover, in the known thermal head shown in FIG. 2, the heat sensitive record paper is urged against the thermal head with a very strong force by means of a press roller 6, but since the printing surface is flat, the roller is brought into contact with the thermal head over a larger area and thus the pressing force per unit area is decreased. This results in that an influence of the roller deformation and abrasion might occur.

In order to mitigate the above problems, the inventors have proposed a thermal head, in which a printing surface is curved outwardly or is protruded from one surface of a protection layer and a driving IC is provided on the other surface of the protection layer. In this thermal head having the protruded printing surface, the heat sensitive record paper is urged against the printing surface with an extremely large force. However, this introduces the above mentioned problems of undesired deformation of the heat storage layer and undesired decrease in an image quality.

SUMMARY OF THE INVENTION

The present invention has for its object to provide a novel and useful thermal head having a large mechanical strength and a high image quality.

It is another object of the invention to provide a thermal head having a printing surface against which a heat sensitive record medium can be urged at a large force and a heat can be efficiently transferred to the record medium without causing undesired deformation of the thermal head.

According to a first aspect of the invention, a thermal head comprises:

- a protection layer having mutually opposed first and second surfaces, said first surface including a smooth printing surface which is brought into contact with a heat sensitive record medium;
- a heat generating section provided on said second surface of the protection layer at a position corresponding to said printing surface and including heat generating resistors and electrodes connected to the heat generating resistors for generating heat to be transferred to said heat sensitive record medium through said printing surface of the protection layer;
- a driving circuit connected to said electrodes of the heat generating section for supplying a heating electric power to the electrodes; and
- a heat storage layer made of a glass having a low melting point and provided on a side of said heat generating section remote from said protection layer.

According to the invention, it is preferable to make the heat storage layer of a glass having a melting point within a range of 300–450° C., particularly 350–400° C.

In a preferable embodiment of the thermal head according to the first aspect of the invention, a barrier layer is provided between said heat generating section and said heat storage layer, said barrier layer serving to prevent an undesired diffusion of substances contained in the low melting point glass of the heat storage layer into the heat generating section.

According to the invention, the protection layer includes the smooth printing surface which is free from a step corresponding to a thickness of the electrodes, and the smooth printing surface may be generally formed to be flat or protruded from the remaining surface of the protection layer.

According to a second aspect of the invention, a thermal head comprises:

- a protection layer having mutually opposed first and second surfaces, said first surface including a printing surface which is brought into contact with a heat sensitive record medium and is protruded from the remaining first surface of the protection layer;
- a heat generating section provided on said second surface of the protection layer at a position corresponding to said protruded printing surface and including heat generating resistors and electrodes connected to the heat generating resistors for generating heat to be transferred to said heat sensitive record medium through said protruded printing surface of the protection layer;
- a driving circuit connected to said electrodes of the heat generating section for supplying a heating electric power to the electrodes;
- a reinforcing member provided on a side of said beat generating section remote from said protection layer; and
- a supporting member made of a synthetic resin, said reinforcing member being covered with said supporting member.

In the thermal head according to the second aspect of the present invention, said reinforcing member may be made of an aggregate of ceramic particles, a glass or a rod lake member. In case of forming the reinforcing member by a glass, a glass dispersion is applied on the rear surface of the heat generating section by means of screen printing or dispenser and is then solidified again. Furthermore, said supporting member may be made of a heat resistant synthetic resin such as epoxy resin and polyimide resin containing inorganic particles such as alumina, silica and glass particles.

Furthermore, according to the thermal head of the present invention, although the reinforcing member serves as a heat storage member, a separate heat storage member may be provided between the heat generating section and the reinforcing member.

According to a third aspect of the invention, a thermal head comprises:

- a protection layer having mutually opposed first and second surfaces, said first surface including a printing surface which is brought into contact with a heat sensitive record medium and is protruded from the remaining first surface of the protection layer;
- a heat generating section provided on said second surface of the protection layer at a position corresponding to said protruded printing surface and including heat generating resistors and electrodes connected to the heat generating resistors for generating heat to be transferred to said heat sensitive record medium through said protruded printing surface of the protection layer;
- a driving circuit connected to said electrodes of the heat generating section for supplying a heating electric power to the electrodes; and
- a heat control section for controlling a temperature of said heat generating section and being provided on a side of said heat generating section remote from said protection layer.

In a preferable embodiment of the thermal head according to the third aspect of the invention, said heat control section comprises a heat storage layer, which may be made of a glass having a low melting point or a heat resistant synthetic resin such as epoxy resin and polyimide resin. In case of using the heat resistant synthetic resin, ceramic fillers or powders such as alumina and silica and/or metal powders may be added to the synthetic resin for adjusting a mechanical property and a thermal property of the heat storage layer.

In a preferable embodiment of the thermal head according to the third aspect of the invention, said heat control section further comprises a heat conduction member for dissipating a heat stored in the heat storage layer. By suitably constructing said heat storage layer and heat conduction member, the heat control can be performed optimally. In this manner, a rapid heating-up and a prompt cooling-down can be attained. Moreover, said heat control member may be made of a glass rod which also serves as a reinforcing member. Therefore, the mechanical strength of the thermal head can be improved. Further, said heat conduction member may be made of an alumina based ceramic coating agent.

In the thermal head according to the third aspect of the invention, an assembly of the protection layer, heat generating section, heat control section and driving IC may be supported by a supporting member. This supporting member may be famed by a heat resistant synthetic resin or a metal plate. In case of using the heat resistant synthetic resin, the driving IC may be embedded in the supporting member, and in case of using a metal substrate plate, the driving IC may be provided in a recess formed in the metal substrate plate.

According to the invention, said protection layer is preferably made of a material selected from the group consisting of SiC compounds, SiB compounds, SiN compounds, AlN compounds, BN compounds, SiBP compounds, SiBN compounds, SiBC compounds, BPN compounds and BCN compounds.

The present invention also relates to a method of manufacturing the thermal head, and has its object to provide a novel and useful method, by means of which the thermal head can be manufactured precisely and efficiently at a low cost.

According to a fourth aspect of the invention, a method of manufacturing a thermal head comprises the steps of:

forming a protection layer on a flat surface of a preliminary substrate, forming a heat generating section on said protection layer, said heat generating section including heat generating resistors and electrodes connected to the resistors;

forming a heat storage layer made of a low melting point glass on said heat generating section such that said heat generating resistors and a part of said electrodes are covered with the heat storage layer; and removing said preliminary substrate.

In such a method according to the invention, after forming the protection layer and heat generating section on the flat surface of the preliminary substrate, the heat storage layer is formed on a side of the heat generating section remote from the protection layer, and therefore the printing surface of the thermal head can be flat.

In the method according to the fourth aspect of the invention, a barrier layer may be formed between said heat generating section and said heat storage layer. Furthermore, said heat storage layer may be secured to a supporting member.

According to a fifth aspect of the invention, a method of manufacturing a thermal head comprises the steps of:

forming a groove in a surface of a preliminary substrate;

forming a protection layer on an inner surface of said groove as well as on said surface of the preliminary substrate, a portion of said protection layer provided on the inner surface of the groove constituting a printing surface;

forming a heat generating section on said protection layer at least at said groove, said heat generating section including heat generating resistors and electrodes connected to the resistors;

forming a reinforcing member on said heat generating section such that said heat generating resistors and at least a part of the electrodes are covered with said reinforcing member; and removing at least a part of said preliminary substrate such that at least a part of said protruded printing surface of the protection layer is exposed.

In a preferable embodiment of the method according to the fifth aspect of the invention, said preliminary substrate may be removed completely or may be removed partially. In the latter case, the preliminary substrate removing step may include a step of covering an assembly of the preliminary substrate, protection layer and heat generating section with an anti-etching layer, and a step of etching a part of the preliminary substrate. In this case, at first, said preliminary substrate is mechanically polished to such a level that said printing surface is still covered with a thin film of a material of said preliminary substrate, and then, the preliminary substrate is wet-etched or chemically-mechanically polished until said printing surface is exposed.

Further, a heat sink made of a metal such as aluminum and copper may be provided in the substrate in order to improve the heat dissipation property.

Furthermore, in order to reduce a size of the thermal head, it is preferable that an IC constituting said driving circuit is arranged on a second surface of the protection layer, said second surface being opposite to said first surface. In this case, the IC may be embedded in a supporting member made of a resin or may be provided in a recess formed in the second surface of the reinforcing layer or may be provided in a recess formed in the substrate.

According to the invention, said protection layer is preferably made of a material selected from the group consisting of SiC compounds, SiB compounds, SiN compounds, AlN compounds, BN compounds, SiBP compounds, SiBN compounds, SiBC compounds, BPN compounds and BCN compounds, SiBP compounds, SiBN compounds, SiBC compounds, BPN compounds and BCN compounds. In this case, it is preferable that said reinforcing layer is made of a glass such as borosilicate glass.

According to a sixth aspect of the invention, a method of manufacturing a thermal head comprises the steps of:

forming a groove in a surface of a preliminary substrate;

forming a protection layer on an inner surface of said groove as well as on said surface of the preliminary substrate, a portion of said protection layer provided on the inner surface of the groove constituting a printing surface;

forming a heat generating section on said protection layer at least at said groove, said heat generating section including heat generating resistors and electrodes connected to the resistors;

forming a heat control section on said heat generating section such that said heat generating resistors and at least a part of the electrodes are covered with said heat control section; and removing at least a part of said preliminary substrate such that at least a part of said protruded printing surface of the protection layer is exposed.

According to the present invention, it is preferable to conduct said step of removing the preliminary substrate by mechanically polishing said preliminary substrate and by wet-etching or chemical-mechanical-polishing the preliminary substrate.

BRIEF EXPLANATION OF THE DRAWINGS

FIG. 17 is a perspective view showing a glass rod used in the embodiment shown in. FIG. 16.

DESCRIPTION OF THE PREFERRED EMBODIMENT

Figure 1:
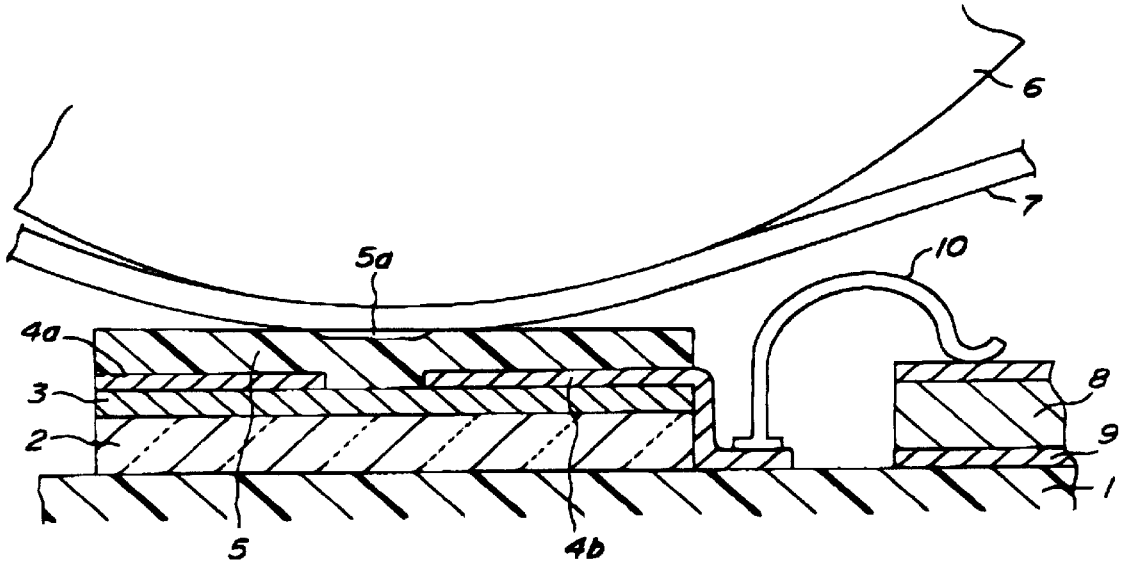
FIG 1 PRIOR ART
FIG. 1 is a cross sectional view showing a known thermal head having a printing surface including a groove.
Figure 2:
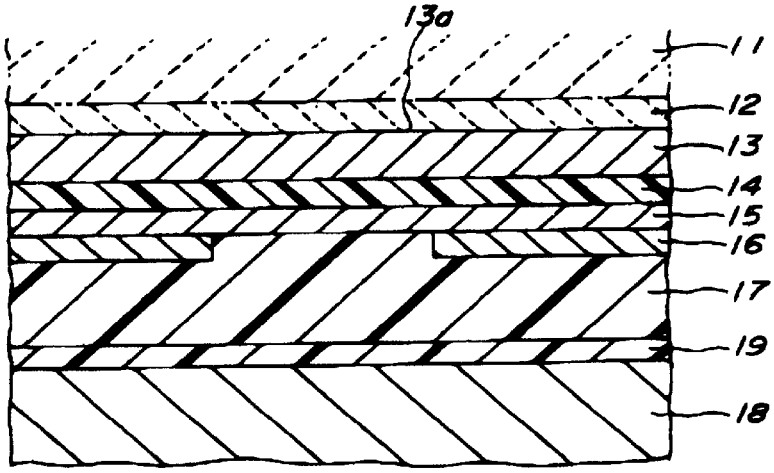
FIG 2 PRIOR ART
FIG. 2 is a cross sectional view depicting a known thermal head having a flat printing surface.
Figure 3:
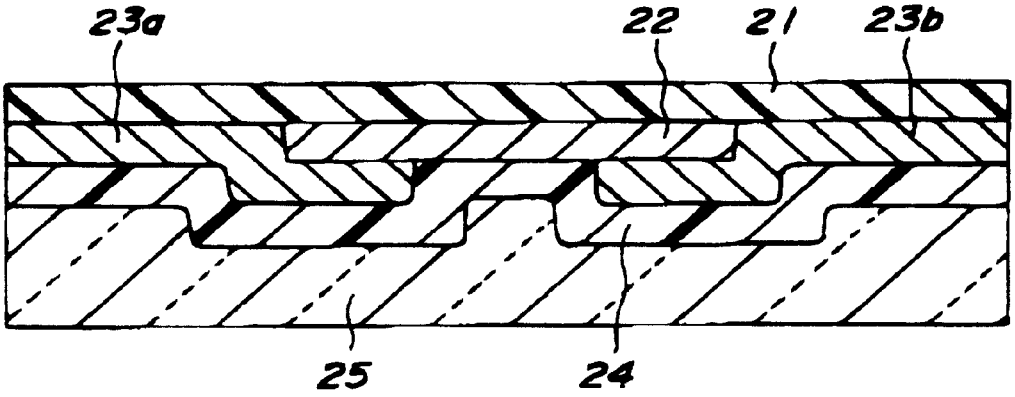
FIG. 3 is a cross sectional view illustrating a heat generating section of a first embodiment of the thermal head according to the invention.
Figure 4:
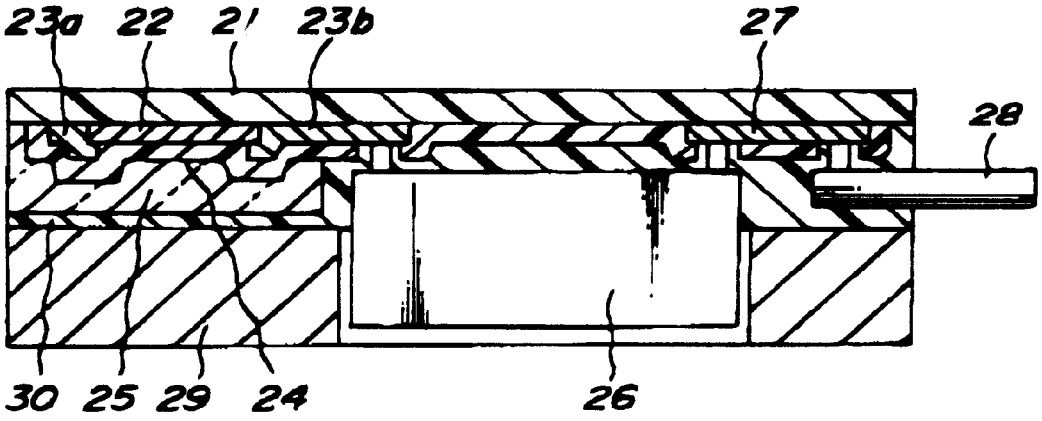
FIG. 4 is a cross sectional view depicting the whole structure of the first embodiment to thermal head according to the invention.

FIGS. 3 and 4 are cross sectional views showing a first embodiment of the thermal head according to the invention. The thermal head comprises a protection layer 21, heat generating resistors 22, a common electrode 23*a* connected commonly to one ends of all the resistors 22, separate electrodes 23*b* each being connected to the other ends of respective resistors 22, a barrier layer 24 and a heat storage layer 25. It should be noted that a number of the heat generating resistors 22 and a number of the separate electrodes 23*b* are aligned in a direction perpendicular to the plane of the drawings of FIGS. 2 and 3. The heat generating resistors 22 and electrodes 23*a*, 23*b* constitute a heat generating section. A heat generated by the heat generating section is transferred to a heat sensitive record medium by means of a flat printing surface of the protection layer 21.

The protection layer 21 may be made of a material selected from the group consisting of SiC compounds. SiB compounds, SiN compounds, AlN compounds and BN compounds, SiBP compounds, SiBN compounds, SiBC compounds, BPN compounds and BCN compounds. Particularly, it is preferable to form the protection layer 21 by a first layer which is brought into contact with the heat sensitive record medium and is made of a hard and chemically stable material having a low coefficient of friction such as SiB and a second layer made of a material having a highly electrically insulating material such as $SiO_2$. The protection layer 21 may be formed by any known method such as plasma CVD.

The heat generating resistors 22 may be made of a material selected from the group consisting of Nb—$SiO_2$, Ni—Cr, Ta, $TiO_2$ and BN. The heat generating resistors 2 may be formed by LP (low pressure) CVD, plasma CVD or sputtering. After depositing a film of an electrically resistive material, the film is selectively etched to form the heat generating resistors 22 having a desired pattern. The etching may be preferably effected by a dry-etching such as RIE (reactive ion etching), but a wet-etching may be also utilized. In case of the dry-etching, $SF_6$, $CF_4$, $Cl_2$, $O_2$ and a mixture thereof may be used as a reactive gas.

The electrodes 23*a*, 23*b* may be made of a metal selected from the group consisting of Al, Cu, Au, Ta, W and Mo. It should be noted that a multi-layer of these metals may be also used as the electrodes 23*a*, 23*b*. According to the invention, the electrodes 23*a*, 23*b* are preferably made of aluminum, because aluminum is cheap, can be adhered to another layer without interposing an additional layer therebetween, has a low electric resistance, and can be easily formed into a desired fine pattern. The electrodes 23*a*, 23*b* may be formed by any conventional method such as evaporation and sputtering.

The patterning for obtaining the common electrodes 23*a* and separate electrodes 23*b* is preferably performed by the wet-etching, although the dry-etching may be utilized. In case of the wet-etching, $H_2SO_4$, $HNO_3$ and a mixture of $H_3PO_4$, $C_2H_4O_2$ and $HNO_3$ may be used as an etchant.

The barrier layer 24 is provided for preventing undesired out-diffusion of a material of the heat storage layer 25, and may be-made of $SiO_2$ or SiN. The barrier layer 24 may be formed by LP CVD, plasma CVD or sputtering. Patterning for forming the barrier, layer 24 may be carried out by both the dry-etching and wet-etching. In case of the wet-etching, HF or a mixture of HF and $NH_4F$ may be used as an etchant.

According to the first aspect of the invention, the heat storage layer 25 is made of a glass having a low melting point. When the heat storage layer 25 is made of a glass having a melting point not higher than 450° C., particularly 400° C., the electrodes 23*a*, 23*b* made of aluminum can be effectively prevented from being oxidized or altered during the formation of the heat storage layer 25. When the heat storage layer 25 is made of a glass having a melting point not higher than 300° C., particularly 350° C. the heat storage layer might be deformed by a heating process to be conducted after the formation of the heat storage layer. Therefore, it is preferable to make the heat storage layer 25 of a glass having a melting point from 300–450° C., particularly 350–400° C.

The heat storage layer 25 made of a low melting point glass may be formed by means of screen printing or by using a dispenser, and a sintering may be carried out at 350–400° C. The heat storage layer 25 is preferably made of a lead glass of PbO—$B_2O_3$ or PbO—$B_2O_3$—ZnO.

FIG. 4 is a cross sectional view showing a whole construction of the thermal head of the present embodiment. In FIG. 4, a driving IC 26 is connected to the separate electrodes 23*b* as well as to conducting electrodes 27, and the conducting electrodes are connected to conductors 28 which are to be connected to an external circuit not shown. An assembly of the protection layer 21, heat generating section 22, 23*a*, 23*b*, barrier layer 24 and heat storage layer 25 is secured to a heat sink 29 by means of an adhesive layer 30. In the heat sink 30, there is formed a through hole into which the driving IC 26 is inserted. The adhesive layer 30 may be made of an epoxy resin or acrylic resin.

According to the first aspect of the invention, since the heat storage layer 25 is made of a low melting point glass and thus can be formed after the formation of the heat generating section as will be explained later, it is possible to obtain a flat printing surface. Moreover, the mechanical strength of the thermal head can be increased as compared with the known thermal head in which the heat storage layer is made of a heat resistant synthetic resin, and therefore even when hard particles such as sands are introduced between the printing surface and the heat sensitive record medium, the thermal head can be effectively prevented from being damaged.

In the present embodiment, the driving IC 26 is arranged on a side of the protection layer 21 remote from or opposite to the printing surface, the heat sensitive record medium could never be brought into contact with the IC and connecting portions thereof, and thus these portions can be protected from being cut-off or short-circuited. Moreover, since the driving IC 26 can be positioned much nearer to the printing surface, a size of the thermal head can be reduced. Therefore, upon manufacturing the thermal head according to the invention, a much larger number of thermal heads can be formed on a wafer, and a manufacturing cost can be reduced.

Figure 5A:
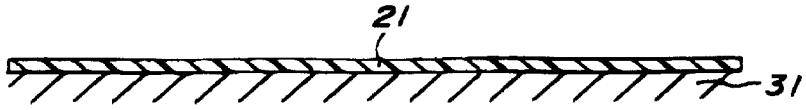
FIGS. 5A–5F are cross sectional views showing successive steps of the method of manufacturing the thermal head shown in FIG. 3.

FIGS. 5A to 5F are cross sectional views showing successive steps for manufacturing the thermal head illustrated in FIG. 3. At first, as shown in FIG. 5A, a protection layer 21 is formed on a surface of a preliminary substrate 31. The preliminary substrate 31 is made of a borosilicate glass which could be easily obtained at a low cost. In the present embodiment, the preliminary substrate 31 is formed by a BLC (trade name) borosilicate glass plate having a thickness of 0.7 mm manufactured by Nippon Denki Glass Company. The protection layer 21 is formed by successively depositing a SiB layer having a thickness of 7 $\mu$m and a $SiO_2$ layer having a thickness of 3 $\mu$m by the plasma CVD at a temperature of 400° C.

Figure 5B:
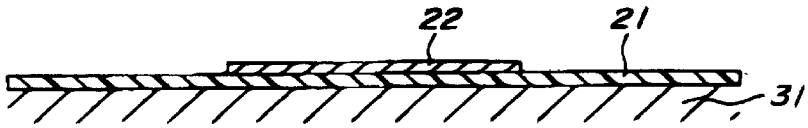

After forming the protection layer 21, a Nb—$SiO_2$ layer having a thickness of 0.1 $\mu$m is deposited on the protection layer by sputtering at a temperature of 300–350° C., and then a patterning process for the Nb—$SiO_2$ layer is carried out by RIE to form an array of heat generating resistors 22 as depicted in FIG. 5B. The heat generating resistors 22 are arranged with a pitch of 167 m and an edge distance of 10 $\mu$m. The Nb—$SiO_2$ layer means an amorphous $SiO_2$ layer having metal Nb, silicide of Nb and oxide of Nb contained therein. After forming the heat generating resistors 22 having a desired pattern, a thermal treatment may be carried out at about 400° C. for improving TCR of the heat generating section.

Figure 5C:
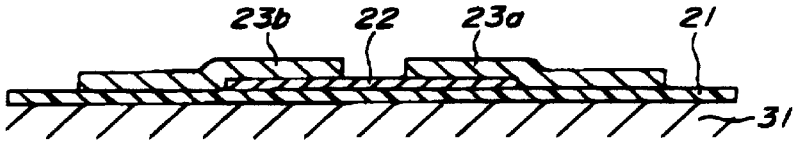

Next, an A1 layer having a thickness of 0.5 $\mu$m is deposited by the evaporation at 100° C., and then the deposited Al layer is etched by using an etchant formed by a mixture of $H_3PO_4$, $C_2H_4O_2$ and $HNO_3$ to form a common electrode 23*a* and separate electrodes 23*b* as illustrated in FIG. 5C. It should be noted that the connecting electrodes 27 (see FIG. 4) are formed simultaneously. The common electrode 23*a* is connected commonly to one ends of the heat generating resistors 22 and the separate electrodes 23*b* are connected to the other ends of respective heat generating resistors 22.

Figure 5D:
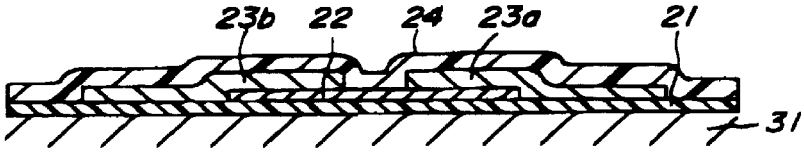
Figure 5E:
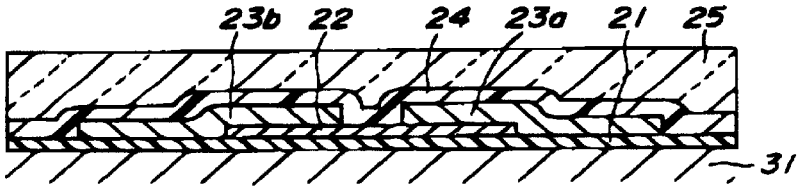

Then, a $SiO_2$ layer having a thickness of 0.3 $\mu$m is deposited by the plasma CVD, and then is etched by using HF etchant to form the barrier layer 24 as illustrated in FIG. 5D.

Figure 5F:
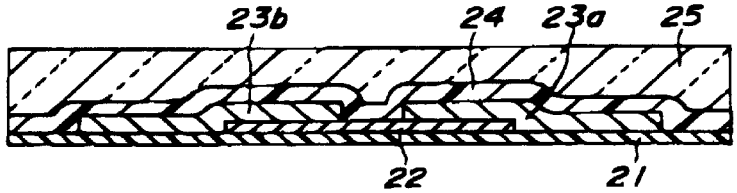

Next, as shown in FIG. 5F, in order to obtain the heat storage layer 25, a glass paste is applied on the barrier layer 24. The glass paste may be prepared by mixing glass flits having a low melting point with a binder. For instance, a commercially available glass paste PLS-1301 (trade name) manufactured by Nippon Denki Glass Company may be used. The glass paste may be applied by a screen printing. After applying the glass paste on the barrier layer 24, the assembly is heated at 360° C. for two hours to sinter the glass paste to form the solidified heat storage layer 25.

Next, the driving IC 26 and conductors 28 are connected to the separate electrodes 23*b* and connecting electrodes 27 by means of flip chip bonding using soldering balls. Then, the assembly is secured to the heat sink 29 formed by an aluminum plate by means of the adhesive layer 30 made of an epoxy resin. In this case, the IC 26 is inserted into the hole formed in the aluminum plate. After that, an assembly is heated to a temperature of 150° C. to harden the adhesive layer 30.

Next, after the assembly is covered with an anti-etching film except for the surface of the preliminary substrate 31, the assembly is immersed into a HF liquid to resolve the preliminary substrate 31 as shown in FIG. 5F. It should be noted that the drawing of FIG. 5F is turned up side down with respect to FIGS. 3 and 4. The anti-etching film may be made of an etching resist sold under a trade name BLACK MASK from Nikka Seiko Company or may be made of a protect wax.

In the present embodiment, the preliminary substrate 31 is made of a cheap borosilicate glass, and therefore the preliminary substrate can be etched away. However, according to the invention, the preliminary substrate 31 may be made of an expensive glass. In this case, it is preferable to form a sacrificial layer such as MgO layer between the preliminary substrate 31 and the protection layer 21 and to separate the preliminary substrate by resolving the sacrificial layer by means of a phosphoric acid. Then, the expensive preliminary substrate 31 can be used repeated times.

In the above mentioned embodiment, after forming the heat generating resistors 22, the electrodes 23*a*, 23*b* are formed, but according to the invention, the electrodes 23*a*, 23*b* may be formed prior to the formation of the heat generating resistors 22.

Figure 6:
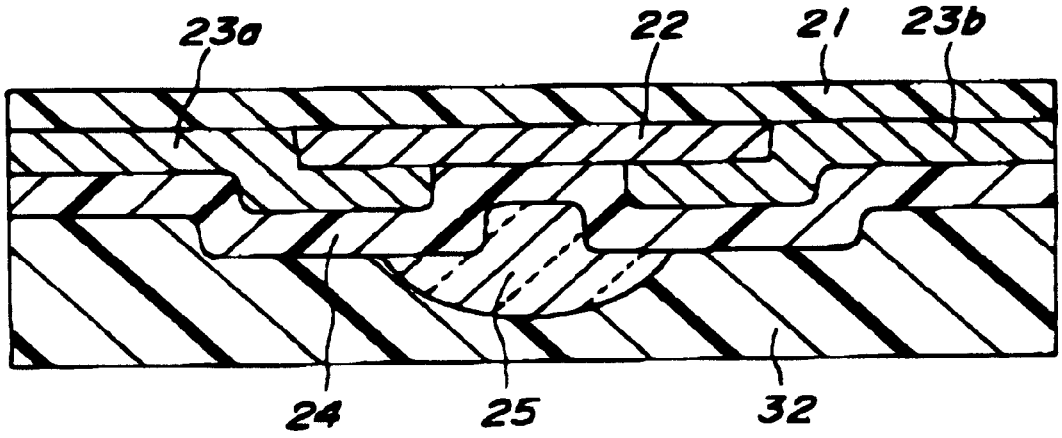
FIG. 6 is a cross sectional view showing a heat generating section of a second embodiment of the thermal head according to the invention.
Figure 7:
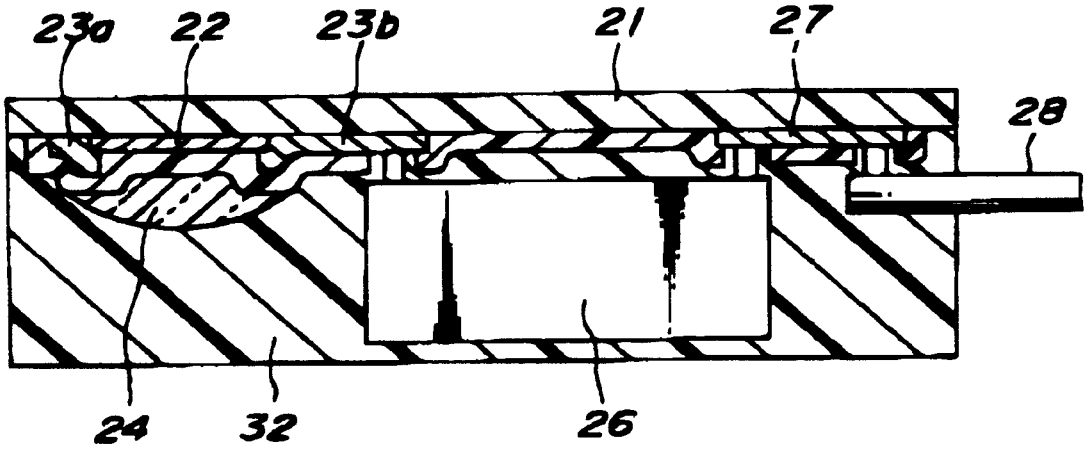
FIG. 7 cross sectional view illustrating a whole structure of the second embodiment of the thermal head according to the invention.

FIGS. 6 and 7 show a second embodiment of the thermal head according to the invention. In the present embodiment, portions similar to those of the first embodiment illustrated in FIGS. 3 and 4 are denoted by the same reference numerals used in FIGS. 3 and 4. In the present embodiment, a heat storage layer 25 made of a low melting point glass is formed on the heat generating section and a whole surface is covered with a supporting member 32 made of a heat resistant synthetic resin such as epoxy resin and polyimide resin. It should be noted that the supporting member 32 also has a heat storing function, and therefore the heat storage layer 25 and supporting member 32 constitute a heat storage member.

In the present embodiment, since the heat storage layer 25 situating below the heat generating section is made of a glass having a low melting point, a mechanical strength of the thermal head is increased. Furthermore, since the heat storage layer 25 is covered with the supporting member 32, the heat storage function is improved and a power consumption of the thermal head can be decreased.

As shown in FIG. 7, the driving IC 26 is embedded in the supporting member 32, and therefore the number of parts and the number of manufacturing steps can be reduced and a cost of the thermal head can be decreased.

Figure 8A:
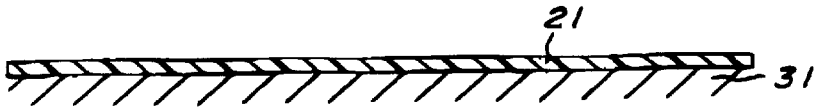
FIGS. 8A–8G are cross sectional views depicting successive steps of the method of forming the second embodiment of the thermal head according to the invention illustrated in FIG. 6.
Figure 8B:
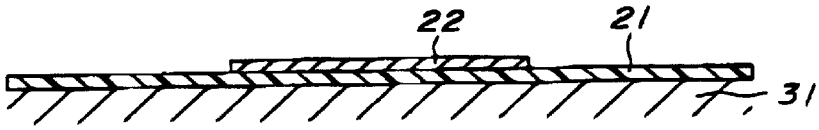
Figure 8C:
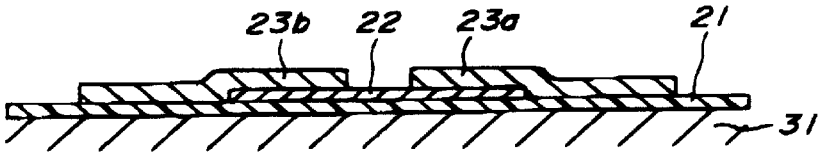
Figure 8D:
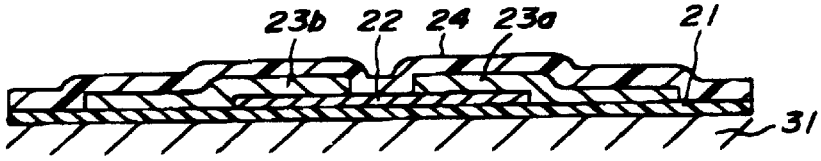
Figure 8E:
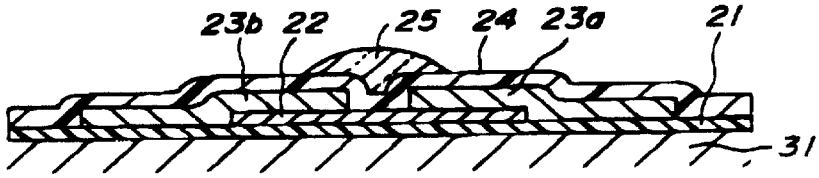

FIGS. 8A–8G are cross sectional views illustrating successive steps of manufacturing the thermal head shown in FIGS. 6 and 7. The steps shown in FIGS. 8A–8D are identical with those depicted in FIGS. 5A–5D. After forming the barrier layer 24 as shown in FIG. 8D, the heat storage layer 25 is formed on the barrier layer by applying a glass paste by means of screen printing or by using a dispenser over a width which is slightly wider than a width of the heat generating section and by heating an assembly to a temperature of 350–400° C. as illustrated in FIG. 8E.

Figure 8F:
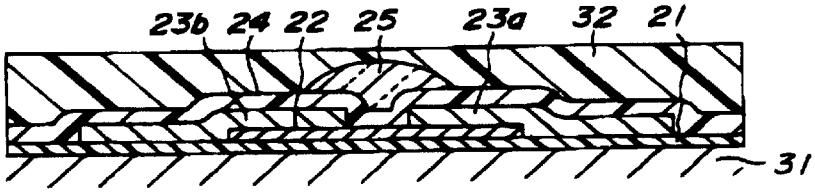
Figure 8G:
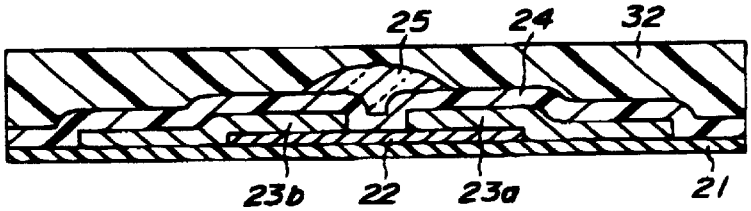

Next, after connecting the driving IC 26 and conductors 28 to the electrodes, the supporting member 32 is formed by applying a past containing a resin over the heat storage layer 25 made of a low melting point glass and by heating an assembly to a temperature of 150° C. to harden the paste as shown in FIG. 8F.

In the present embodiment, the supporting member 32 is provided such that the IC 26 and conductors 28 are fixed by the supporting member, but according to the invention, the supporting member 32 may be provided not to cover the IC 26 and conductors 28. Furthermore, in order to adjust a thermal response of the thermal head, the supporting member 32 may contain metal powders or ceramic powders or fillers such as AlN and $Al_2O_3$ powders.

Figure 9:
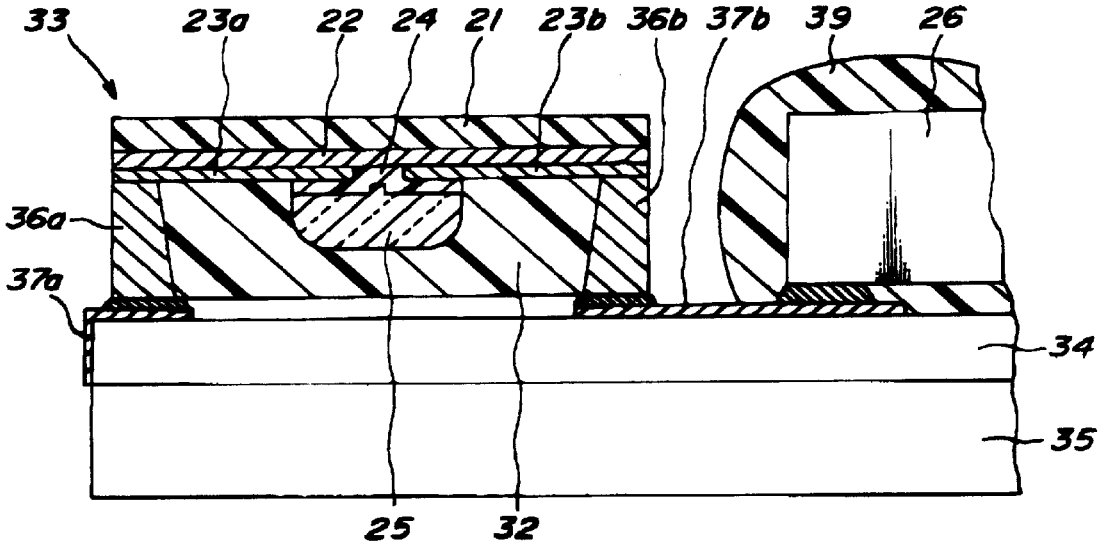
FIG. 9 is a cross sectional view showing a third embodiment of the thermal head according to the invention.

FIG. 9 is a cross sectional view showing a third embodiment of the thermal head according to the present invention. In the present embodiment, a thermal head chip 33 is secured to an insulating substrate 34 which is coupled with a heat sink 35 formed by a metal plate. The insulating substrate 34 may be made of alumina. The thermal head chip 33 comprises the protection layer 21, the heat generating section 22, 23*a*, 23*b*, barrier layer 24, heat storage layer 25 made of a low melting point glass, and supporting member 32 made of a heat resistant synthetic resin. The thermal head chip 33 further comprises a common conductor 36*a* connected to the common electrode 23*a* and separate conductors 36*b* each connected to respective separate electrodes 23*b*. The common conductor 36*a* is connected to a common connector 37*a* by soldering, and similarly the separate conductors 36*b* are coupled with separate conductors 37*b* also by soldering, said separate conductors 37*b* being formed on the surface of the insulating substrate 34. The soldering may be carried out in a conventional manner using a four-layer bonding pad. The driving IC 26 is connected to the separate conductors 37*b* and is fixed by a mold 39 of a synthetic resin.

The common conductor 36*a* and separate conductors 36*b* may be provided by forming through holes or grooves in the supporting member 32 made of polyimide resin or epoxy resin by means of an excimer laser and then by forming electrically conductive plugs within the holes or grooves.

Also in the present embodiment, the heat storage layer 25 is made of a low melting point glass and thus the flat printing surface can be obtained and a mechanical strength of the thermal head can be increased. Moreover, since the electrodes 23*a*, 23*b* of the heat generating section are connected to the conductors 37*a*, 37*b* provided on the surface of the insulating substrate 34 by means of the conductors 36*a*, 36*b*, it is no more necessary to make a distance from the heat generating section to the connecting portion (bonding pads) a long such as 10 mm in the known thermal head, but a width of the thermal head can be shortened such as 2 mm. Therefore, a larger number of thermal heads can be manufactured from a wafer and a cost of the thermal head can be decreased to a large extent.

Figure 10:
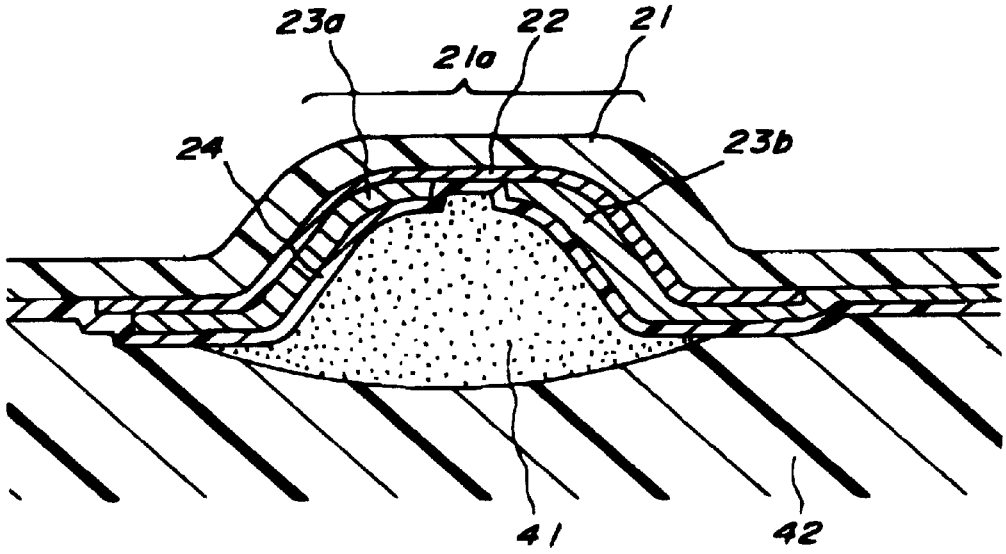
FIG. 10 is a cross sectional view illustrating a fourth embodiment of the thermal head according to the invention.

FIG. 10 is a cross sectional view showing a fourth embodiment of the thermal head according to the invention. Also in the present embodiment, portions similar to those of the previous embodiments are denoted by the same reference numerals used in the previous embodiments and their detailed explanation is dispensed with.

In the present embodiment, a portion of the protection layer 21 is protruded outwardly to form a protruded printing surface 21*a*. Further, in the present embodiment, under the heat generating section formed by the heat generating resistors 22 and electrodes 23*a*, 23*b*, there is provided a reinforcing member 41 made of a hard material and an assembly is supported by a supporting member 42 made of a heat resistant synthetic resin such as eddy resin and polyimide resin.

In the present embodiment, the reinforcing member 41 is made of an aggregation of ceramic or glass particles dispersed in a synthetic resin binder. That is to say, a paste is prepared by mixing ceramic or glass particles with a synthetic resin binder, then the paste is applied on the barrier layer 24 by means of a dispenser, and finally a drying process or sintering process is carried out to solidify the paste. In this manner, it is possible to obtain the very hard reinforcing member 41. According to the invention, both the ceramic particles and glass particles may be contained in the paste. Furthermore, the binder may be made of a glass having a low melting point such as PbO—$B_2O_3$ glass and PbO—$B_2O_3$—ZnO glass. In this case, it is preferable to use the glass binder having a melting point between 300–450° C., particularly 350–400° C. The reason of using such a low melting point glass is same as that of using the low melting point glass for the heat storage layer in the previous embodiments.

The supporting member 42 may be made of a heat resistant synthetic resin such as epoxy resin and polyimide resin. In order to adjust a mechanical strength and thermal property of the supporting member 42, metal powders and/or ceramic powders or fillers may be contained.

The supporting member 42 may be a substrate of the thermal head, and in such a case a separate substrate such as ceramic substrate and glaze substrate, and therefore a cost of the thermal head can be decreased. Furthermore, the supporting member may be secured to a heat sink formed by, for instance an aluminum plate.

Figure 11:
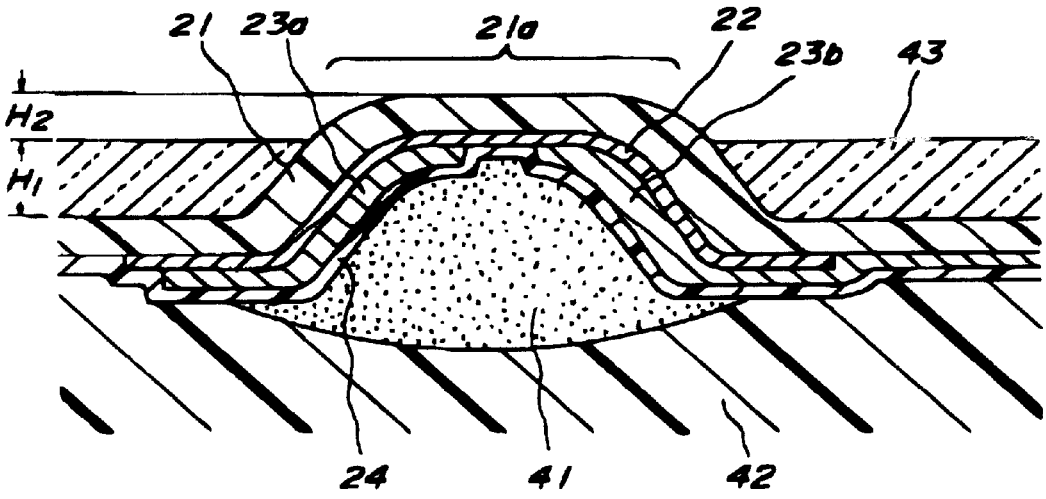
FIG. 11 a cross sectional view showing a fifth embodiment of the thermal head according to the invention.

FIG. 11 is a cross sectional view showing a fifth embodiment of the thermal head according to the invention. The thermal head of the present embodiment is quite similar to that of the embodiment illustrated in FIG. 10. In the embodiment shown in FIG. 10, the whole surface of the protection layer 21 is exposed, but in the present embodiment, a surface of the protection layer 21 is covered with a glass layer 43 having a low melting point except for the protruded printing surface 21*a*. The glass layer 43 serves to reinforce the thermal head. As shown in FIG. 11, the printing surface 21*a* of the protection layer 21 is protruded outwardly, and a substantial part of the heat generating section is formed within this protruded portion.

In the embodiment illustrated in FIG. 11, a thickness $H_1$ of the glass layer 43 is smaller than a height of the printing surface 21*a*. A thickness $H_1$ of the glass layer 43 is preferably set to a value within a range from 200 μm to 500 μm for attaining an effective improvement in a mechanical strength, and a distance $H_2$ from a top surface of the glass layer 43 to the protruded printing surface 21*a* is preferably set to a value within a range from 10 μm to 100 μm, particularly 20 μm to 50 μm for attaining a high definition of image.

FIGS. 12A–12H are cross sectional views showing successive steps of the method of manufacturing the thermal head shown in FIG. 10.

Figure 12A:
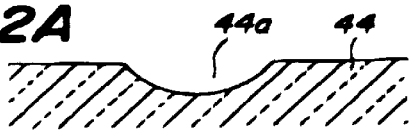
FIGS. 12A–12G are cross sectional views showing successive steps for forming thermal head illustrated in FIG. 10.

At first, as shown in FIG. 12A, a groove 44*a* is formed in a surface of a preliminary substrate 44 made of a borosilicate glass by means of a wet-etching or mechanical cutting. In the present embodiment, the preliminary substrate 44 is formed by a BLC (trade name) borosilicate glass plate having a thickness of 0.7 mm manufactured by Nippon Denki Glass Company, and the groove 44*a* is formed by a wet-etching to have a width of 700 μm and a depth of 300 μm. The groove 44*a* is formed to have a cross sectional configuration of arc, but it may have a trough shape having a flat bottom surface.

Figure 12B:
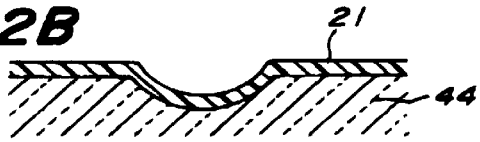

Next, as illustrated in FIG. 12B, a protection layer 21 is formed on the surface of the preliminary substrate 44 as well as on an inner wall of the groove 44*a*. The protection layer 21 is formed by successively depositing a SiB layer having a thickness of 7 μm and a $SiO_2$ layer having a thickness of 3 μm by the plasma CVD at a temperature of 400° C.

Figure 12C:
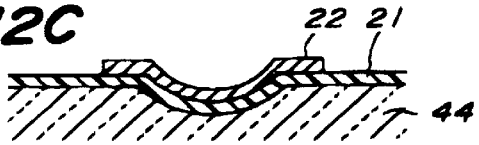

After forming the protection layer 21, a Nb—$SiO_2$ layer having a thickness of 0.1 μm is deposited on the protection layer by sputtering at a temperature of 300–350° C., and then a patterning process for the Nb—$SiO_2$ layer is carried out by RIE to form an array of heat generating resistors 22 as depicted in FIG. 12C. The heat generating resistors 22 are arranged with a pitch of 167 μm and an edge distance of 10 μm. After forming the heat generating resistors 22, a thermal treatment may be carried out at about 400° C. for improving TCR of the heat generating section.

Figure 12D:
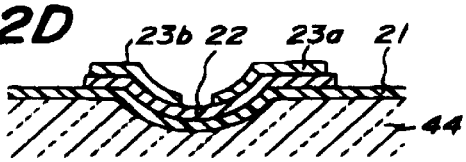

Next, an Al layer having a thickness of 0.5 μm is deposited by the evaporation at 100° C., and then the deposited Al layer is etched by using an etchant formed by a mixture of $H_3PO_4$, $C_2H_4O_2$ and $HNO_3$ to form a common electrode 23*a* and separate electrodes 23*b* as illustrated in FIG. 12D.

Figure 12E:
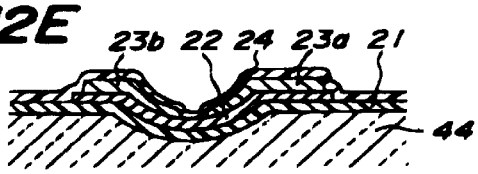

Then, a $SiO_2$ layer having a thickness of about 2 μm is deposited by the plasma CVD, and then is etched by using HF etchant to form a barrier layer 24 as illustrated in FIG. 12E.

Figure 12F:
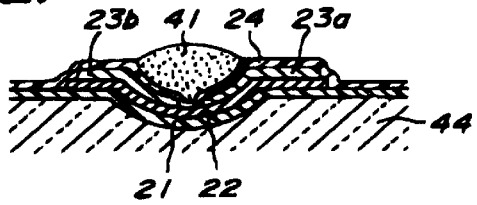

Next, in order to form the reinforcing member 41, a paste obtained by mixing silica particles with a binder made of a synthetic resin is applied on the barrier layer 24 along a recess, and then an assembly is heated at 150° C. for two hours to solidify the paste. In this manner, the reinforcing member 41 is formed as shown in FIG. 12F. The paste may be applied by means of screen printing or a dispenser.

Figure 12G:
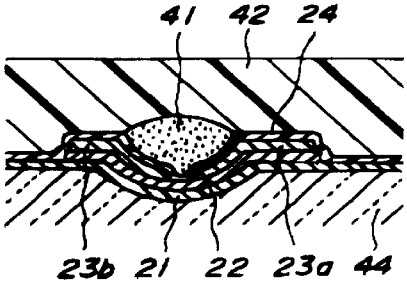

Next, as depicted in FIG. 12G, the supporting member 42 is formed by applying a paste including polyimide resin and by heating the assembly at 350° C. for two hours to harden the paste.

Figure 12H:
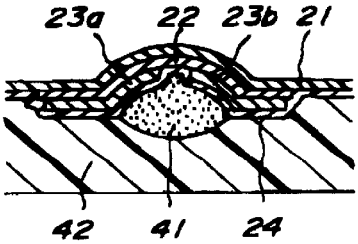

After the assembly is covered with an anti-etching film except for the surface of the preliminary substrate 25, the assembly is immersed into a HF liquid to resolve the preliminary substrate 44 as shown in FIG. 12H. It should be noted that the drawing of FIG. 12H is turned up side down with respect to FIGS. 12A–12G.

In order to manufacture the thermal head illustrated in FIG. 11, the preliminary substrate 44 may be partially removed to form the glass layer 43. This partial removal of the preliminary substrate 44 can be performed efficiently in the following manner. At first, a part of the preliminary substrate 44 is removed by a mechanical polishing from its upper surface to a level which is slightly higher than a level of the protruded surface of the protection layer 21. Then, the assembly is covered with an anti-etching layer except for the surface of the preliminary substrate 44, and a part of the preliminary substrate is removed by the wet-etching using, for instance HF etchant or by the chemical-mechanical polishing (CMP) or by a combination of these wet-etching and CMP. In CMP, abrasion particles such as silica particles are contained in an etchant and the etchant is flowed with respect to the surface of the preliminary substrate 44.

Figure 13:
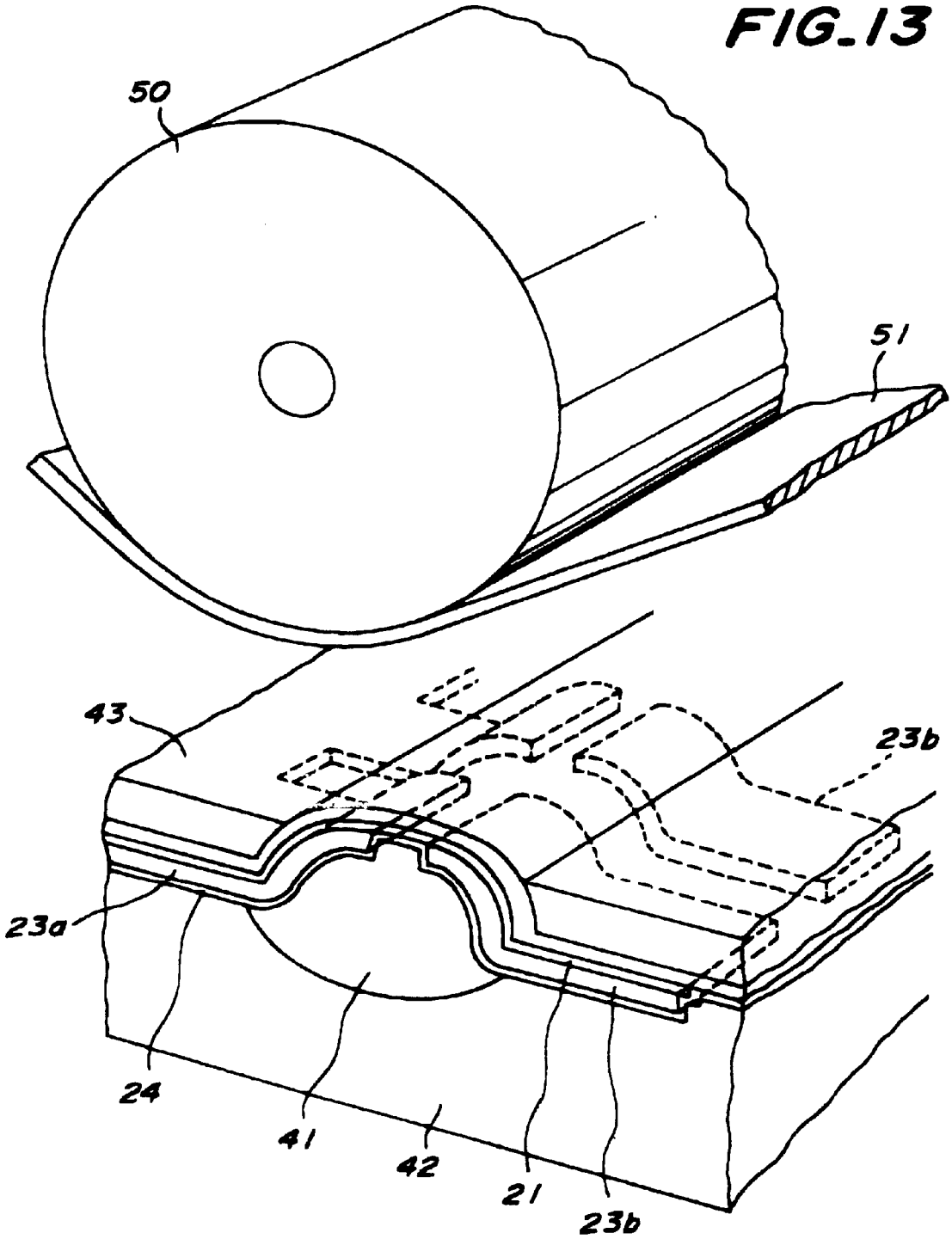
FIG. 13 is a perspective view depicting the thermal head shown in FIG. 11 together with press roller and heat sensitive record paper.

FIG. 13 is a perspective view showing the thermal head illustrated in FIG. 11 together with a pressure roller 50 and a heat sensitive record paper 51. Since the printing surface 21*a* of the thermal head is protruded outwardly, the record paper 51 can be pressed against the printing surface by the press roller 50 with a very large force. In this case, the reinforcing member 41 and glass layer 43 are provided on opposite sides of the heat generating section, the heat generating section could hardly be deformed or damaged. Therefore, if hard particles such as sands are introduced between the printing surface 21*a* and the record paper 51, the heat generating section can be effectively prevented from being damaged. In this manner, the thermal head according to the invention can have a very high resolution.

Furthermore, in the present embodiment, since the reinforcing member 41 effectively serves as a heat storage member, a thermal property of the heat generating section can be improved.

As stated above, in the present embodiment, the printing surface 21*a* is protruded outwardly, and thus the record paper 51 is urged against the printing surface with a very large force. Therefore, a mechanism for producing a pressing force by the pressure roller 50 can be simplified. Moreover, since the heat generating section and reinforcing member 41 serves as rib, a mechanical strength of the thermal head is increased and a bending of the thermal head can be effectively reduced.

The supporting member 42 is made of a synthetic resin such as polyimide resin and epoxy resin. Mechanical strength and thermal conductance of the supporting member 42 may be adjusted by adding ceramic fillers or powders such as alumina and silica and/or metal powders.

It should be noted that the supporting member 42 may constitute a substrate of the thermal head. Then, a conventional substrate such as a ceramic substrate and glaze substrate may be dispensed with, and therefore a cost of the thermal head according to the invention can be reduced. If desired, the supporting member 42 may be cemented to a metal substrate plate serving as a heat sink. The metal substrate plate may be made of aluminum or copper.

Figure 14:
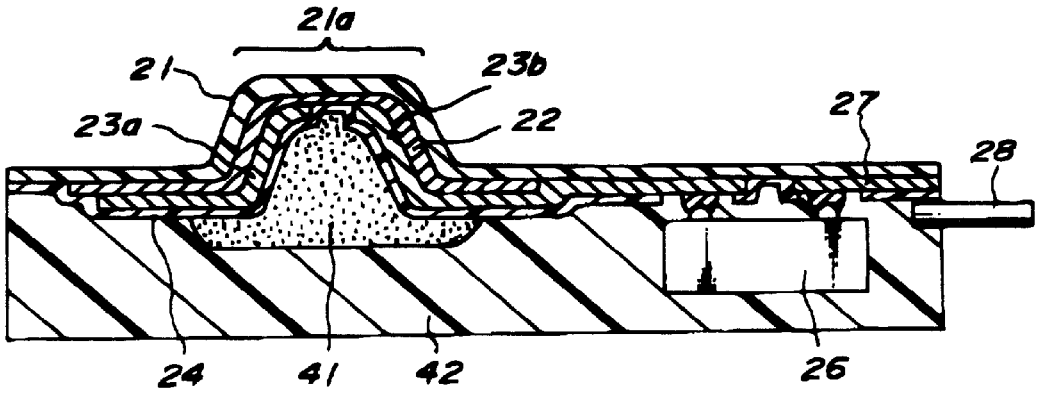
FIG. 14 is a cross sectional view showing a sixth embodiment of the thermal head aching to the invention.

FIG. 14 is a cross sectional view showing a sixth embodiment of the thermal head according to the invention. In the present embodiment, a driving circuit for supplying an electric power to the heat generating resistors 22 is constituted by an IC 26, which is connected to the separate electrodes 23*b* and connecting electrodes 27 by flip chip bonding. The IC 26 is embedded in the supporting member 42 made of a synthetic resin. To the connecting electrodes 27 are connected conductors 28 for connecting the IC 26 to an external circuit not shown. As shown in FIG. 14, the IC 26 is provided on a side of the protection layer 1 which is opposite to a side of the printing surface 21*a* facing the recording medium.

In this manner, the IC 26 is provided on a side of the protection layer 21 remote from the printing surface 21*a*, the record medium could never be brought into contact with the IC, and therefore a distance between the printing surface 21*a* and the IC 26 can be shortened as compared with the known thermal bead in which the IC is arranged on the same side of the protection layer as the printing surface. In this manner, the thermal head can be miniaturized. Furthermore, since the record medium is not brought into contact with the IC 26 as well as the connecting electrodes 27 for connecting the IC to the external circuit, undesired cut-off and short-circuit can be effectively prevented.

In the embodiment shown in FIG. 14, the supporting member 42 made of a synthetic resin also serves to hold the IC 26 and conductors 28 in position, and therefore it is possible to reduce the number of parts and process steps. In this manner, the cheap thermal head can be obtained. Moreover, according to the invention, since the glass layer 43 serving as a reinforcing member is provided on the protection layer 21 above the separate electrodes 23*b* and connecting electrodes 27 connected to the IC 26, these electrodes can be effectively protected from being cut-off although the thermal head is deformed. In this manner, a reliability of the thermal head is improved.

Further, since a size of the thermal head is reduced, a number of thermal heads manufactured from a single preliminary substrate can be increased. Therefore, the thermal heads can be manufactured efficiently at a low cost.

Figure 15:
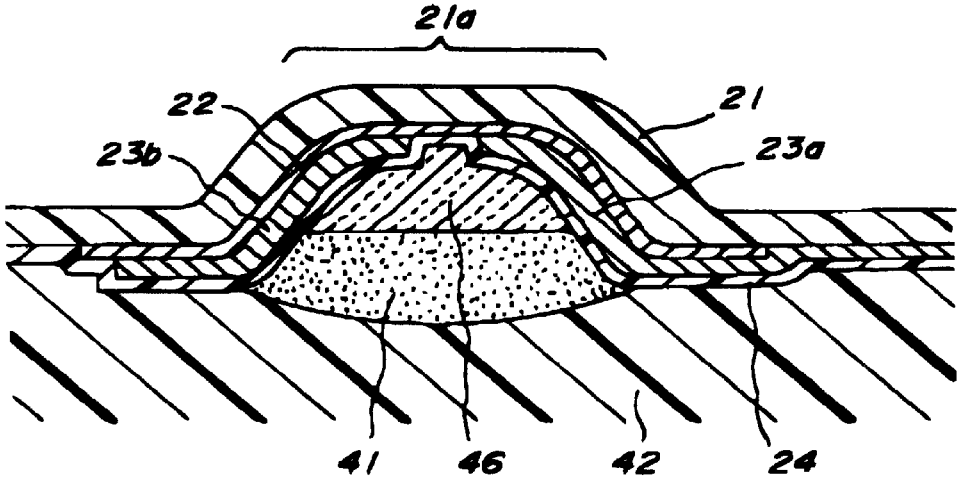
FIG. 15 is a cross sectional view illustrating a seventh embodiment of the thermal head according to the invention.

FIG. 15 is a cross sectional view illustrating a seventh embodiment of the thermal head according to the invention. In the present embodiment, between the barrier layer 24 and the reinforcing member 41 is arranged a heat storage member 46 made of a glass having a low melting point. By designing a size of the heat storage member 46, a thermal property of the thermal head can be precisely adjusted.

Figure 16:
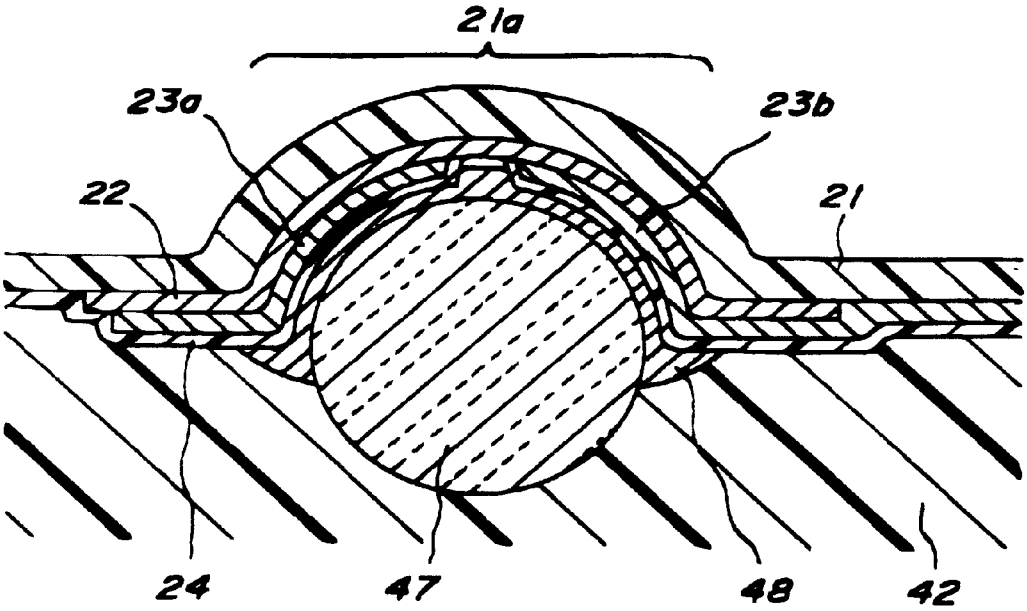
FIG. 16 a cross sectional view depicting an eighth embodiment of the thermal heat according to the invention.
Figure 17:
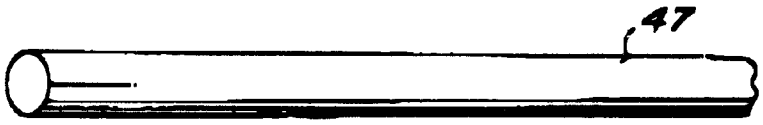

FIGS. 16 and 17 are cross sectional views showing an eighth embodiment of the thermal head according to the invention. In the present embodiment, the reinforcing member is formed by a glass rod 47 which is secured to the barrier layer 24 by means of an adhesive layer 48 made of a heat resistant synthetic resin such as epoxy resin and polyimide resin. The glass rod 47 has a diameter which corresponds to an arc of the protruded printing surface 21*a*. Also in the present embodiment, the glass rod 47 serves as the reinforcing member as well as the heat storage member.

Figure 18:
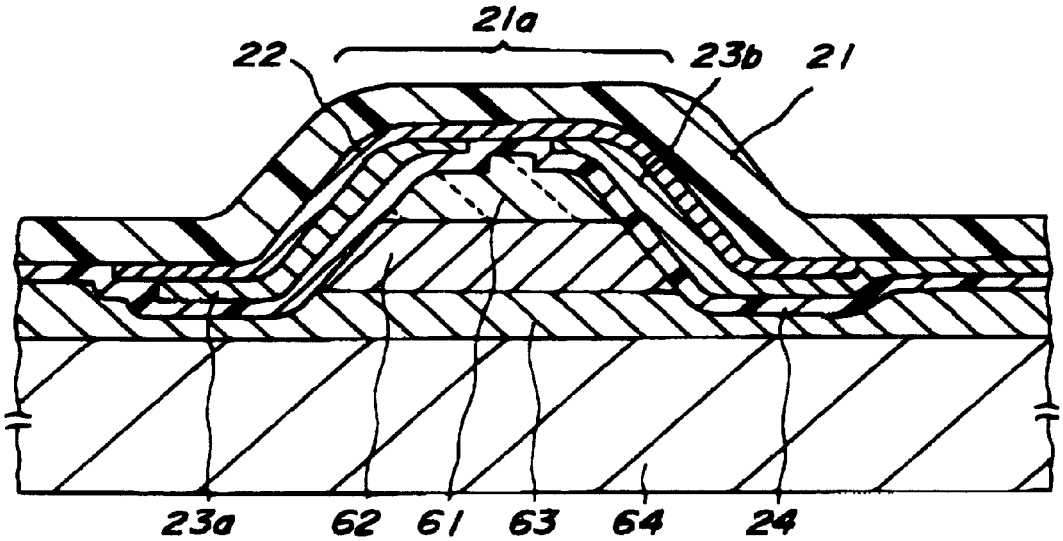
FIG. 18 is a cross sectional view illustrating a ninth embodiment of the thermal head according to the invention.

FIG. 18 is a cross sectional view showing a ninth embodiment of the thermal head according to the invention. In the present embodiment, below the heat generating section, there are provided a reinforcing member formed by a heat storage layer 61 and a heat conduction layer 62, and an assembly of the protection layer 21, heat generating section and reinforcing member is secured to a substrate 64 serving as a heat sink by means of an adhesive layer 63. The heat storage layer 61 is made of a glass having a low melting point, but it may be made of a heat resistant synthetic resin such as polyimide and epoxy. In order to adjust a mechanical property and a thermal property of the heat storage layer 61, ceramic fillers such as alumina fillers and silica fillers or metal powders may be added to the low melting point glass. The heat conduction layer 62 may be made of an alumina based ceramic coating agent. The adhesive layer 63 may be made of a silicone resin containing alumina fillers for adjusting a thermal property.

In the embodiment shown in FIG. 18, the heat conduction member 62 is formed by the alumina based ceramic coating agent, but according to the invention the heat conduction member 62 may be formed by depositing a gold thin film on the heat storage layer, applying a cream solder on the gold film, and then by curing the cream solder in a re-flow furnace. Alternatively, the heat conduction member 62 may be formed depositing a thin film of gold, copper or nickel on and near the heat storage layer, and depositing a film of copper or nickel by an electroplating.

The present invention is not limited to the embodiments explained above, but many alternations and modifications may be conceived by those skilled in the art within the scope of the invention. For instance, in the above embodiments, after forming the heat generating resistors 22, the electrodes 23*a* and 23*b* connected to the resistors are formed. However, according to the invention, the electrodes 23*a* and 23*b* may be formed prior to the formation of the heat generating resistors 22.

Furthermore, according to the invention, the glass rod 47 shown in FIGS. 16 and 17 may be replaced by a metal rod. In such a modification, the metal rod may be secured to the barrier layer 14 by means of the heat storage layer 48 serving as are adhesive layer.

Moreover, in the embodiment shown in FIG. 16, after securing the glass rod 47 to the barrier layer 24, a heat sink may be secured to the barrier layer and glass rod by means of the supporting member 42 serving as arc adhesive layer.

What is claimed is:

1. A thermal head comprising:

a protection layer having mutually opposed first and second surfaces, said first surface including a smooth printing surface which is brought into contact with a heat sensitive record medium;

a heat generating section provided on said second surface of the protection layer at a position corresponding to said printing surface and including heat generating resistors and electrodes connected to the heat generating resistors for generating heat to be transferred to said heat sensitive record medium through said printing surface of the protection layer;

a driving circuit connected to said electrodes of the heat generating section for supplying a heating electric power to the electrodes; and a heat storage layer made of a glass having a low melting point and provided on a side of said heat generating section remote from said protection layer, the melting point of the glass is from 300° C. to 450° C.

2. A thermal head according to claim 1, wherein said heat storage layer is made of a glass having a melting point from 350° C. to 400° C.

3. A thermal head according to claim 2, wherein said thermal head further comprises a barrier layer provided between said heat generating section and said heat storage layer.

4. A thermal head according to claim 3, wherein said heat storage layer made of a low melting point glass is provided on the barrier layer at a restricted portion beneath the printing surface, and a supporting member made of a heat resistant synthetic resin is provided on the barrier layer such that the heat storage layer is covered with said supporting member.

5. A thermal head according to claim 4, wherein said driving circuit is formed by an IC which is provided on a side of the protection layer remote from the printing surface.

6. A thermal head according to claim 5, wherein said thermal head further comprises a heat sink formed by a metal plate to which said heat storage layer secured by means of an adhesive layer.

7. A thermal head according to claim 1, wherein said protection layer is made of a material selected from the group consisting of SiC compounds, SiB compounds, SiN compounds, AlN compounds, BN compounds, SiBP compounds, SiBN compounds, SiBC compounds, BPN compounds and BCN compounds.

* * * * *